US010117506B2

(12) United States Patent
Crowley et al.

(10) Patent No.: US 10,117,506 B2
(45) **Date of Patent: *Nov. 6, 2018**

(54) FINGER PUPPET TOOTHBRUSH

(71) Applicant: THE BRUSHIES LLC, Santa Barbara, CA (US)

(72) Inventors: Colleen Crowley, Carmel, CA (US); Hilary Fritsch, Carmel, CA (US)

(73) Assignee: THE BRUSHIES LLC, Santa Barbara, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/788,205

(22) Filed: Oct. 19, 2017

(65) Prior Publication Data

US 2018/0103746 A1 Apr. 19, 2018

Related U.S. Application Data

(63) Continuation of application No. 15/402,410, filed on Jan. 10, 2017, now Pat. No. 9,820,560, which is a continuation-in-part of application No. 29/581,527, filed on Oct. 19, 2016, now abandoned, and a continuation-in-part of application No. 29/581,526, filed on Oct. 19, 2016, now abandoned, and a continuation-in-part of application No. 29/581,525, filed on Oct. 19, 2016, now abandoned, and a continuation-in-part of application No. 29/581,523, filed on Oct. 19, 2016, now abandoned.

(51) Int. Cl.
*A46B 5/04* (2006.01)
*A46B 15/00* (2006.01)

(52) U.S. Cl.
CPC ..... *A46B 5/04* (2013.01); *A46B 15/0089* (2013.01); *A46B 2200/1066* (2013.01)

(58) Field of Classification Search
CPC ..... A46B 5/04; A46B 15/0089
USPC ..... D4/103, 124, 125, 126; 15/227
See application file for complete search history.

(56) References Cited

U.S. PATENT DOCUMENTS

| | | | |
|---|---|---|---|
| D339,234 | S | 9/1993 | Vianson |
| 5,826,599 | A | 10/1998 | Adams |
| 5,873,140 | A | 2/1999 | Holloway |
| 5,875,513 | A | 3/1999 | Reinold |
| 5,924,429 | A | 7/1999 | Morando |
| 6,145,153 | A | 11/2000 | Weihrauch |
| D492,117 | S | 6/2004 | Sarkar et al. |
| 6,941,607 | B1 | 9/2005 | Berglass |
| D552,355 | S | 10/2007 | Roehrig |
| 9,409,689 | B2 | 8/2016 | Nguyen |
| 2002/0112302 | A1 | 8/2002 | Harrison |
| 2003/0088933 | A1 | 5/2003 | Woods |
| 2007/0022552 | A1 | 2/2007 | Scheepers |

OTHER PUBLICATIONS

USPTO; Notice of Allowance dated Sep. 20, 2017 in U.S. Appl. No. 15/402,410.

*Primary Examiner* — Randall Chin
(74) *Attorney, Agent, or Firm* — Snell & Wilmer, L.L.P.

(57) ABSTRACT

A finger puppet toothbrush may include character features, such as an imitation animal body, arms, legs, teeth, eyes, tail, etc. The various character features may provide different brushing functions to the toothbrush. However, due to the disguised appearance of the functional features as character parts, small children may be enticed to use the toothbrush more willingly and develop proper dental hygiene.

14 Claims, 5 Drawing Sheets

FINGER PUPPET TOOTHBRUSH

CROSS-REFERENCE TO RELATED APPLICATIONS

This application is a continuation of, and claims priority to U.S. Ser. No. 15/402,410, now U.S. Pat. No. 9,820,560, entitled "ANIMAL CHARACTER TOOTHBRUSH" and filed on Jan. 10, 2017, the contents of which are incorporated by reference herein in their entirety. The '410 application is a continuation-in-part of, and claims priority to U.S. Ser. No. 29/581,527, entitled "WHALE FINGER PUPPET TOOTHBRUSH" and filed on Oct. 19, 2016, the contents of which are incorporated by reference herein in their entirety. The '410 application is a continuation-in-part of, and claims priority to U.S. Ser. No. 29/581,526, entitled "PIG FINGER PUPPET TOOTHBRUSH" and filed on Oct. 19, 2016, the contents of which are incorporated by reference herein in their entirety. The '410 application is a continuation-in-part of, and claims priority to U.S. Ser. No. 29/581,525, entitled "MONKEY FINGER PUPPET TOOTHBRUSH" and filed on Oct. 19, 2016, the contents of which are incorporated by reference herein in their entirety. The '410 application is a continuation-in-part of, and claims priority to U.S. Ser. No. 29/581,523, entitled "DINOSAUR FINGER PUPPET TOOTHBRUSH" and filed on Oct. 19, 2016, the contents of which are incorporated by reference herein in their entirety.

FIELD

The present disclosure relates generally to dental hygiene products, and more specifically to toothbrushes.

BACKGROUND

Proper dental hygiene is important for people of all ages. However, convincing children to brush their teeth and gums regularly can be difficult. Existing toothbrushes for children can be difficult for children to use, may not be adequately designed to handle the unique challenges of cleaning young gums and emerging teeth, and are not enjoyable for children to use. Thus, many children do not maintain good dental hygiene and do not establish good habits for the future.

SUMMARY

A toothbrush may comprise: an imitation animal body comprising a closed end and an open end, wherein the imitation animal body is cylindrical, wherein the imitation animal body comprises a hollow interior, and wherein the hollow interior is configured to receive a finger; a forward appendage coupled to the imitation animal body; a rear appendage coupled to the imitation animal body; a top appendage coupled to a top surface of the imitation animal body, wherein the top appendage comprises a first ridge and a second ridge, wherein a height of the first ridge is greater than a height of the second ridge; a platform coupled to a bottom surface of the imitation animal body, wherein the platform comprises a planar surface; a plurality of first bristles extending from the planar surface of the platform; and a plurality of second bristles distributed around a perimeter of the platform.

In various embodiments, the first ridge and the second ridge may form a tongue scraper. The forward appendage may be configured to assist in removal of the toothbrush from a finger. A diameter of each of the plurality of second bristles may be greater than a diameter of each of the plurality of first bristles. A reinforcing ring may be adjacent to the open end of the imitation animal body. The toothbrush may be injection molded. The imitation animal body, the forward appendage, the rear appendage, the top appendage, the platform, the plurality of first bristles, and the plurality of second bristles comprise an elastomeric material. A radius of a base of the closed end may be greater than a radius of the imitation animal body. The closed end may comprise a face of an animal. The plurality of first bristles may be configured to brush teeth, and the plurality of second bristles may be configured to brush gums. All of the plurality of first bristles and all of the plurality of second bristles may be coupled to the platform. The forward appendage may be an arm of an animal character, and the rear appendage may be a leg of the animal character.

A finger puppet toothbrush may comprise: a cylindrical body of an imitation character, wherein the cylindrical body comprises an open end and a closed end, wherein the closed end comprises a face of the imitation character; a tail of the imitation character coupled to a top surface of the cylindrical body; a left forward appendage of the imitation character coupled to a left side of the imitation character; a right forward appendage of the imitation character coupled to a right side of the imitation character; a left rear appendage of the imitation character coupled to the left side of the imitation character; a right rear appendage of the imitation character coupled to the right side of the imitation character; a platform coupled to the closed end of the cylindrical body; and a plurality of bristles coupled to the platform.

In various embodiments, the plurality of bristles form teeth of the imitation character. The imitation character may be a dinosaur, a monkey, a pig, or a whale. The tail may comprise a first ridge and a second ridge, wherein the first ridge and the second ridge are configured to scrape bacteria from a tongue. The right forward appendage and the left forward appendage may be configured to assist in removal of the finger puppet toothbrush from a human finger. The finger puppet toothbrush may comprise eyes on the closed end of the cylindrical body. The plurality of bristles may comprise an elastomeric material. A radius of a base of the closed end may be greater than a radius of the cylindrical body.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the drawing figures, wherein like numerals denote like elements.

DETAILED DESCRIPTION

The detailed description of various embodiments herein makes reference to the accompanying drawings, which show various embodiments by way of illustration. While these various embodiments are described in sufficient detail to enable those skilled in the art to practice the inventions, it should be understood that other embodiments may be realized and that logical, chemical and mechanical changes may be made without departing from the spirit and scope of the inventions. Thus, the detailed description herein is presented for purposes of illustration only and not of limitation.

Furthermore, any reference to singular includes plural embodiments, and any reference to more than one component or step may include a singular embodiment or step. Also, any reference to attached, fixed, connected or the like may include permanent, removable, temporary, partial, full and/or any other possible attachment option. Additionally, any reference to without contact (or similar phrases) may also include reduced contact or minimal contact. Surface shading lines may be used throughout the figures to denote different parts but not necessarily to denote the same or different materials.

Finger puppet toothbrushes in the shape of imitation characters are disclosed (e.g., animals, superheros, robots, princesses, cartoons, political figures, parents, friends, pets, etc.). In various embodiments, and for illustration purposes, the characters may be imitation animals. An adult or child may insert a finger into an open end of the toothbrush. The toothbrush may include imitation animal features, such as an imitation animal body, arms, legs, teeth, eyes, tail, etc. The various animal features may provide different functions to the toothbrush. However, due to the disguised appearance of the functional features as imitation animal parts, small children may be enticed to use the toothbrush more willingly and develop proper dental hygiene.

Figure 1:
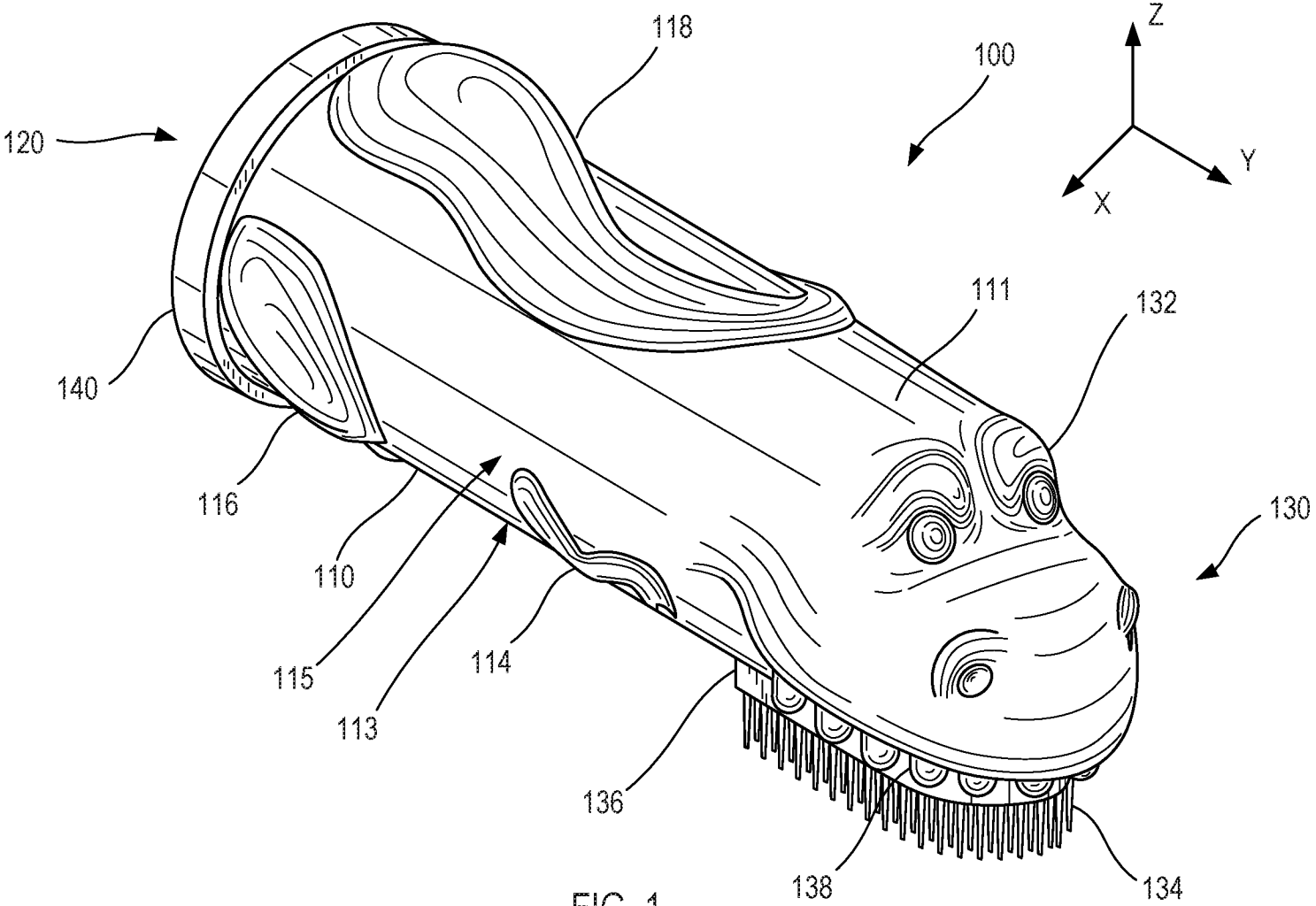
FIG. 1 illustrates a perspective view of a toothbrush in accordance with various embodiments.

Referring to FIG. 1, a perspective view of a toothbrush 100 is illustrated according to various embodiments. The toothbrush 100 may be a finger puppet toothbrush, such that a user may place a finger inside the toothbrush 100 to manipulate the toothbrush 100. Toothbrush 100 may also fit over a regular toothbrush, an electric toothbrush, a stick or any other device. The toothbrush 100 is in the shape of an imitation animal character. The toothbrush 100 may comprise an imitation animal body 110. The imitation animal body 110 may be cylindrical. The imitation animal body 110 may comprise a hollow interior. The toothbrush 100 may comprise an open end 120 and a closed end 130. The open end 120 may be configured to allow a user's finger to be inserted through the open end 120 and into the hollow interior of the cylindrical imitation animal body 110. The user may then manipulate the toothbrush 100 to brush the user's teeth and gums, or the teeth and gums of another person, such as a child.

The closed end 130 may comprise various functional features which together form a face of the animal. The closed end 130 may comprise eyes 132 protruding from a top surface 111 of the imitation animal body 110. The eyes 132 may comprise eyebrows and eyeballs. The closed end 130 may comprise first bristles 134 extending from a platform 136 coupled to a bottom surface 113 of the imitation animal body 110. The closed end 130 may comprise second bristles 138 coupled to the side of the platform 136. The second bristles 138 may represent teeth of the animal.

The toothbrush 100 may comprise a forward appendage 114 protruding from a side surface 115 of the imitation animal body 110. X-y-z axes are provided for ease of illustration. As used herein, the forward or positive y-direction generally refers to the closed end 130 of the toothbrush 100. The positive z-direction generally refers to the upper or top surface 111 of the toothbrush 100. The positive x-direction generally refers to the right side of the toothbrush 100. The negative x-direction generally refers to the left side of the toothbrush 100.

As used herein, a "side" refers to the quadrant of the imitation animal body 110 located closest to a respective axis. Thus, the "top side" or "top surface 111" refers to the quadrant of the imitation animal body 110 located closest to the positive z-axis. The "bottom side" or "bottom surface 113" refers to the quadrant of the imitation animal body 110 located closest to the negative z-axis. The "right side" or "right surface" refers to the quadrant of the imitation animal body 110 located closest to the positive x-axis. The "left side" or "left surface" refers to the quadrant of the imitation animal body 110 located closest to the negative x-axis.

In various embodiments, the forward appendage 114 may be an arm, leg, wing, hand, foot, or fin of the animal. The forward appendage 114 may provide a gripping location to assist in removing the toothbrush 100 from a finger. The toothbrush 100, and in particular the smooth surface of the imitation animal body 110, may become slippery when wet, thus the protruding forward appendage 114 may facilitate in removal of the toothbrush 100.

The toothbrush 100 may comprise a rear appendage 116 protruding from the side surface 115 and adjacent to the open end 120 of the imitation animal body 110. In various embodiments, the rear appendage 116 may be an arm, leg, wing, hand, foot, or fin of the animal. The toothbrush 100 may further comprise a top appendage 118 protruding from the top surface 111 and adjacent to the open end 120 of the imitation animal body 110. In various embodiments, the top appendage 118 may be a tail of the animal. The toothbrush 100 may comprise a reinforcing ring 140 at the open end 120 of the imitation animal body 110. In combination with the top appendage 118 and the rear appendage 116, the reinforcing ring 140 may provide additional strength to the open end 120 of the imitation animal body 110, where the toothbrush 100 may be susceptible to tearing due to stretching of the material when a finger is inserted or removed from the hollow interior of the imitation animal body 110.

Figure 2:
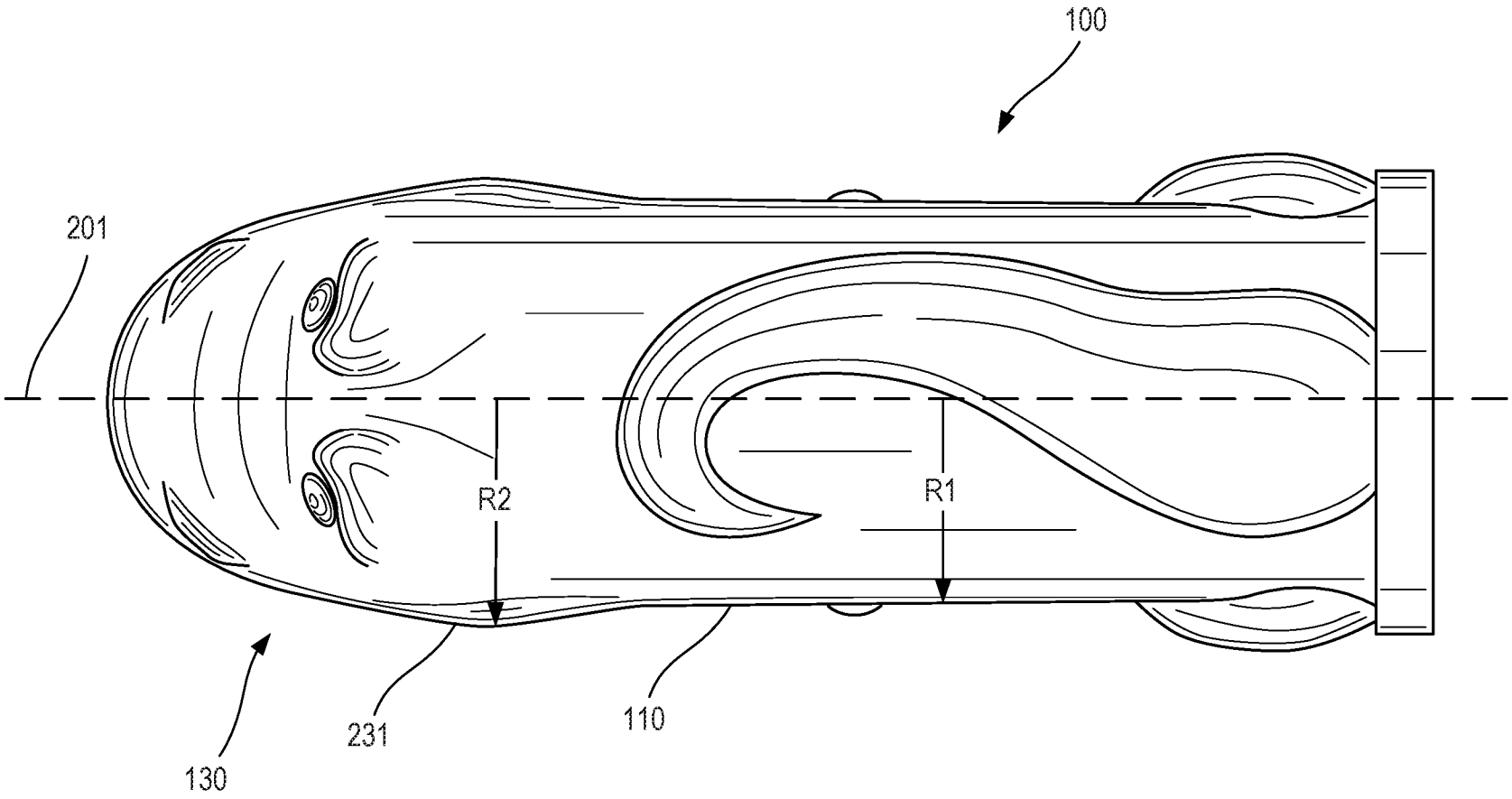
FIG. 2 illustrates a top view of a toothbrush in accordance with various embodiments.

Referring to FIG. 2, a top view of the toothbrush 100 is illustrated according to various embodiments. The imitation animal body 110 may comprise a central axis 201. The imitation animal body 110 may comprise a radius R1 measured from the central axis 201 to the exterior of the imitation animal body 110. The toothbrush 100 may flare outward at a base 231 of the closed end 130, such that the base 231 of the closed end 130 comprises a radius R2 which is greater than the radius R1 of the imitation animal body 110. Similar to a pacifier, the larger radius R2 of the base 231 may encourage infants and small children to enclose their mouth around the closed end 130 of the toothbrush 100, which improves the likelihood that a child will tolerate and enjoy the act of brushing their teeth and gums.

Figure 3:
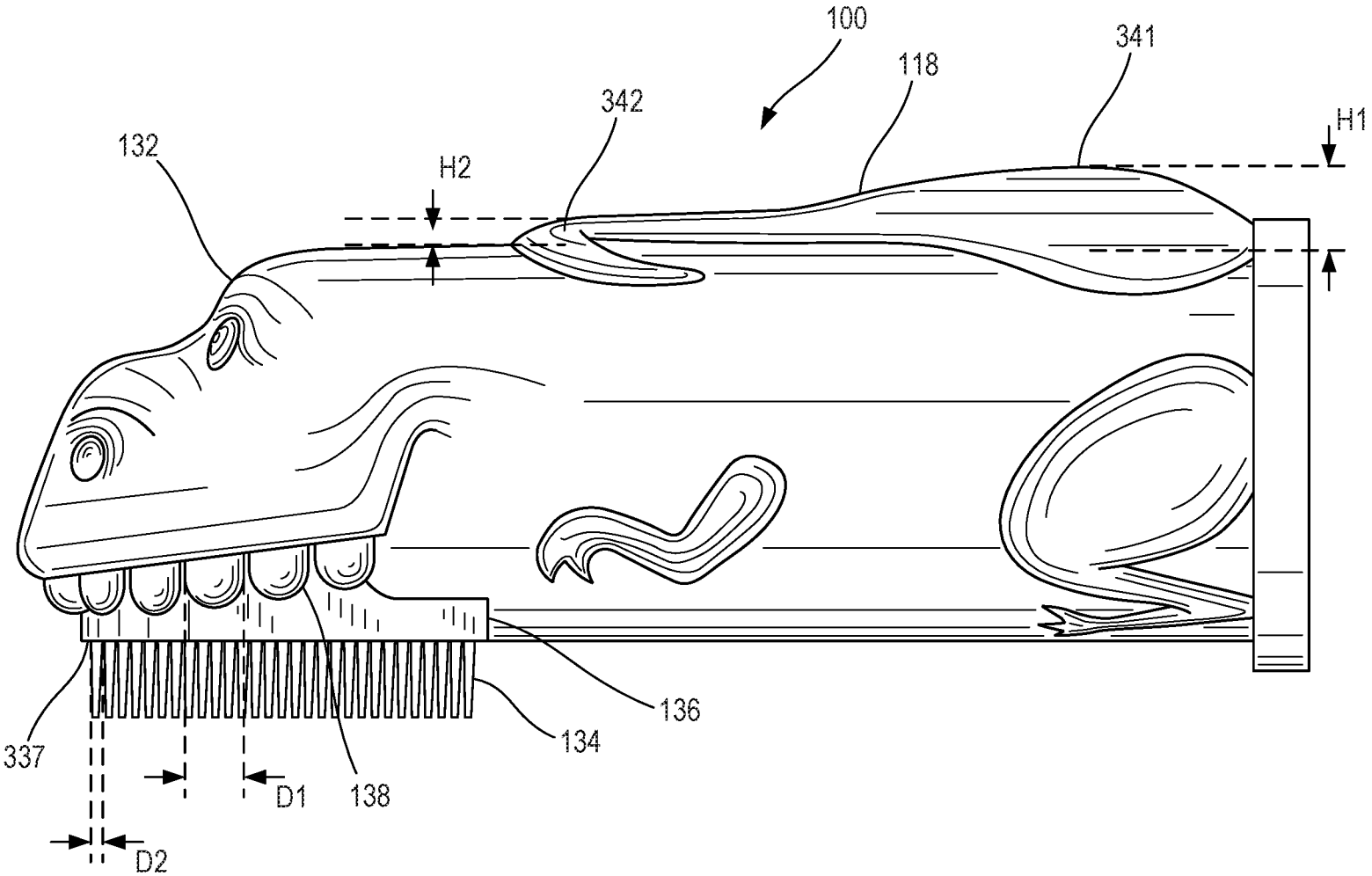
FIG. 3 illustrates a left side view of a toothbrush in accordance with various embodiments.

Referring to FIG. 3, a left side view of the toothbrush 100 is illustrated according to various embodiments. The first bristles 134 may extend downward from the platform 136. In various embodiments, the platform 136 may comprise a planar surface 337. Because the first bristles 134 extend from the planar surface 337, the first bristles 134 may be parallel to each other, which may provide greater brushing effectiveness than non-parallel bristles extending from curved surfaces, in which the tips of the bristles may be too far apart to provide sufficiently effective brushing. The second bristles 138 may be distributed around the platform 136. The second bristles 138 may be formed as teeth of the animal. The second bristles 138 may have a greater diameter D1 than a diameter D2 of the first bristles 134. Additionally, the second bristles 138 may be shorter than the first bristles 134. The second bristles 138 may generally be rounded nubs, which may be gentler for brushing against sensitive gums of infants. Thus, in various embodiments the first bristles 134 may be utilized for brushing teeth, where the thinner first bristles 134 may be better suited to the small nooks and crannies between teeth, and the second bristles 138 may be utilized for gently brushing and massaging gums and other soft tissue in the mouth.

In various embodiments, the top appendage 118 may comprise a rear ridge 341 and a forward ridge 342. The rear ridge 341 may protrude from the top of the imitation animal body 110 by a first height H1, and the forward ridge 342 may protrude from the top of the imitation animal body 110 by a second height H2. The first height H1 may be greater than the second height H2. The ridges 341, 342 of the top appendage 118, in some cases in combination with the eyes 132, may together form a tongue scraper which may be used to remove bacteria from the tongue of a child. Thus, a user may use the first bristles 134 and second bristles 138 to brush the teeth and gums of a child, and rotate the user's finger to use the top appendage 118 to scrape the tongue of the child.

Figure 4:
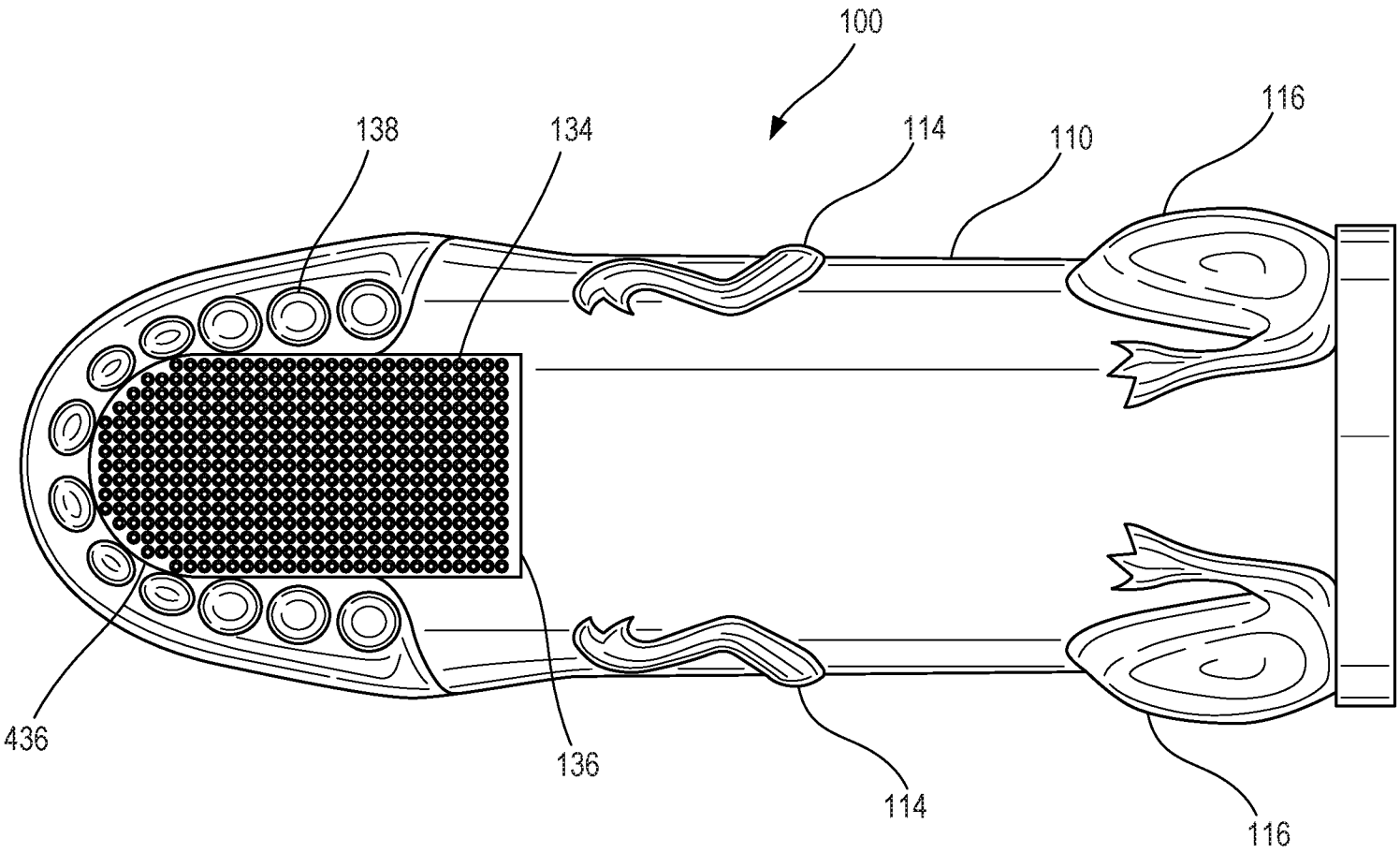
FIG. 4 illustrates a bottom view of a toothbrush in accordance with various embodiments.

Referring to FIG. 4, a bottom view of the toothbrush 100 is illustrated according to various embodiments. In various embodiments, all of the first bristles 134 may be coupled to the platform 136, and no bristles may extend from the imitation animal body 110. By keeping the first bristles 134 limited to the platform 136, a user may prevent inadvertent contact of bristles with parts of the mouth other than the desired location. The second bristles 138 may be located around the perimeter 436 of the platform 136. The toothbrush 100 may comprise two forward appendages 114 and two rear appendages 116. However, in various embodiments the toothbrush 100 may comprise any suitable number of forward appendages 114 and rear appendages 116.

Figure 5:
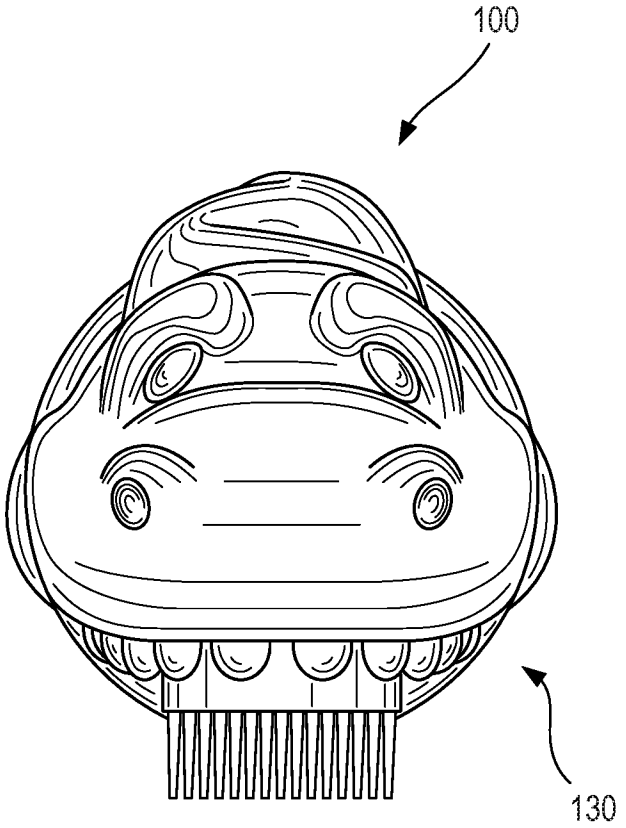
FIG. 5 illustrates a front view of a toothbrush in accordance with various embodiments.

Referring to FIG. 5, a front view of the toothbrush 100 is illustrated according to various embodiments. When the toothbrush 100 is being inserted into a child's mouth, the child may see the closed end 130 of the toothbrush 100. Thus, the child may see the face of the animal, and think of the toothbrush 100 as a toy, rather than a hygiene product. The child may therefore be excited to brush their teeth and develop good dental hygiene habits.

Figure 6:
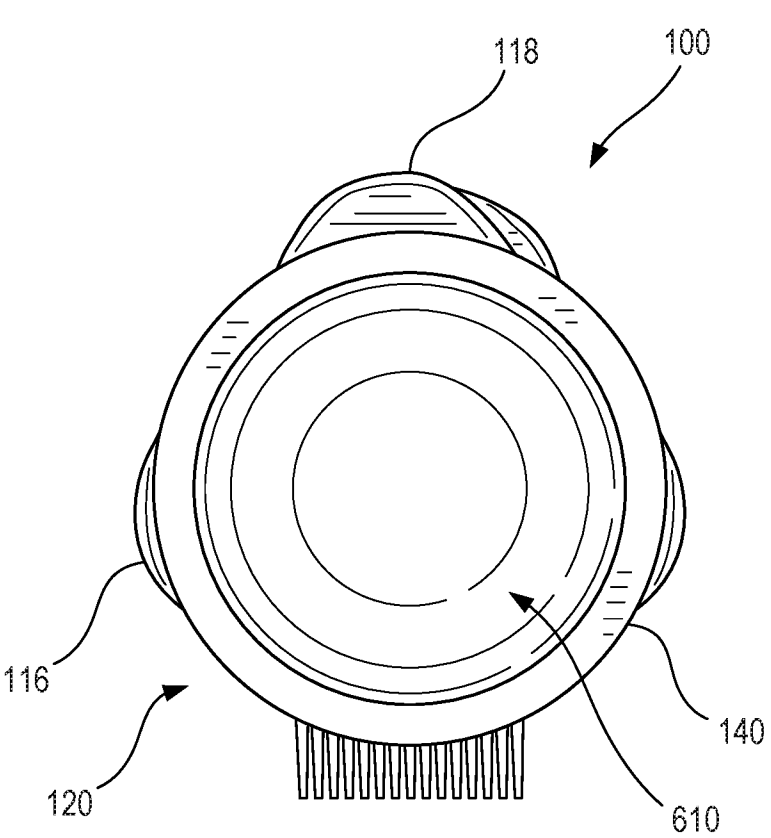
FIG. 6 illustrates a rear view of a toothbrush in accordance with various embodiments.

Referring to FIG. 6, a rear view of the toothbrush 100 is illustrated according to various embodiments. The toothbrush 100 may comprise a hollow interior 610 into which an adult or child may insert their finger to use the toothbrush 100. The reinforcing ring 140, in combination with the top appendage 118 and the rear appendages 116 may provide a greater thickness to the open end 120 of the toothbrush 100, and thus provide added strength to the open end 120 of the toothbrush 100, where a significant amount of stretching and potential for tears occurs during use.

In various embodiments, the toothbrush 100 may be entirely made from the same material. For example, the toothbrush 100 may comprise an elastomeric material, which is able to bend and stretch easily without tearing. In various embodiments, the toothbrush 100 may comprise silicone. The toothbrush 100 may be BPA free. In various embodiments, the entire toothbrush 100 may be injection molded. By creating the toothbrush 100 from a single material and/or from a single mold, the toothbrush 100 may be durable and easily cleanable. For example, the toothbrush may be hand-washed or be cleaned in a dishwasher.

Although shown as a dinosaur, those skilled in the art will recognize that various animal or other characters may be used in the form of a finger puppet toothbrush, in which the functional characteristics of the toothbrush may be disguised as body parts of the character. In this manner, children may learn that dental hygiene can be fun, and children may establish proper dental hygiene habits which may continue throughout their lives.

Systems, methods and apparatus are provided herein. In the detailed description herein, references to "one embodiment," "an embodiment," "various embodiments," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f), unless the element is expressly recited using the phrase "means for." As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the inventions. The scope of the inventions is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C.

We claim:

1. A toothbrush comprising:

an imitation character body comprising a closed end and an open end, wherein the imitation character body is cylindrical, wherein the imitation character body comprises a hollow interior;

a reinforcing ring adjacent to the open end of the imitation character body;

a top appendage coupled to a top surface of the imitation character body, wherein the top appendage comprises a first ridge and a second ridge, wherein a height of the first ridge is greater than a height of the second ridge;

a platform coupled to the imitation character body, wherein the platform comprises a planar surface; and a plurality of first bristles extending from the planar surface of the platform.

2. The toothbrush of claim 1, wherein the first ridge and the second ridge form a tongue scraper.

3. The toothbrush of claim 1, further comprising a forward appendage configured to assist in removal of the toothbrush from a finger.

4. The toothbrush of claim 1, further comprising a plurality of second bristles distributed around a perimeter of the platform.

5. The toothbrush of claim 1, wherein the toothbrush is injection molded.

6. The toothbrush of claim 1, wherein the imitation character body, the top appendage, the platform, and the plurality of first bristles comprise an elastomeric material.

7. The toothbrush of claim 1, wherein a radius of a base of the closed end is greater than a radius of the imitation character body.

8. The toothbrush of claim 1, wherein the closed end comprises a face of a character.

9. The toothbrush of claim 1, wherein the plurality of first bristles form teeth of the imitation character body.

10. The toothbrush of claim 9, wherein the imitation character body is a superhero, a robot, a princess, a cartoon character, a political figure, a parent, a friend, a pet, a monster, a puppet character, a dinosaur, a monkey, a pig, or a whale.

11. The toothbrush of claim 10, wherein the first ridge and the second ridge are configured to scrape bacteria from a tongue.

12. The toothbrush of claim 11, wherein the top appendage of the imitation character body is configured to assist in removal of the toothbrush from a human finger.

13. The toothbrush of claim 12, further comprising eyes on the closed end of the imitation character body.

14. The toothbrush of claim 13, wherein a radius of the reinforcing ring is greater than a radius of the imitation character body.

* * * * *